United States Patent [19]

Brillinger et al.

[11] Patent Number: 5,016,408

[45] Date of Patent: May 21, 1991

[54] SEALED WALL CONNECTION TO RAISED FLOOR FOR USE IN GERM-FREE CHAMBERS OR THE LIKE

[75] Inventors: Martin Brillinger, Würzburg; Wolfgang Hiller, Karlstadt-Laudenbach; Ulrich Klingelhoefer, Waldbuettelbrunn; Manfred Radtke, Margetshoechheim, all of Fed. Rep. of Germany

[73] Assignee: Mero-Werke Dr. Ing. Max Mengeringhausen GmbH & Co., Fed. Rep. of Germany

[21] Appl. No.: 218,900

[22] Filed: Jul. 14, 1988

[30] Foreign Application Priority Data

Jul. 18, 1987 [DE] Fed. Rep. of Germany ..... 3723907

[51] Int. Cl.[5] ..... E04B 2/82

[52] U.S. Cl. ..... 52/126.6; 52/241

[58] Field of Search ..... 52/126.3, 126.5, 126.6, 52/241, 242, 293

[56] References Cited

U.S. PATENT DOCUMENTS

| | | | |
|---|---|---|---|
| 3,251,163 | 5/1966 | Russell | 52/126.6 |
| 3,423,892 | 1/1969 | Rimington | 52/241 |
| 3,503,166 | 3/1970 | Nakazawa et al. | 52/126.6 |
| 3,811,237 | 5/1974 | Bettinger | 52/126.6 |
| 4,621,470 | 11/1986 | Balinski | 52/241 |
| 4,733,509 | 3/1988 | Takahashi | 52/126.5 |

FOREIGN PATENT DOCUMENTS 3723907.4 7/1987 Fed. Rep. of Germany .

*Primary Examiner*—Michael Safavi

*Attorney, Agent, or Firm*—Frank P. Presta

[57] ABSTRACT

In order to simplify the production of sealed wall connections in the case of raised floors, especially to allow the disassembly of the floor tiles (11) even in the area of the connected wall (10), the wall (10) carries on its bottom edge (20) one or more socket profile rails (21). The socket profile rails (21) are supported on upright support members (31) provided at least on posts (12). However, it is also possible to support the socket profile rails (21) on profiles in the form of rectangular pipes which are laid out in the grating on the posts (12). The bottom (24) of the socket profile rail (21) extends from the middle in opposite directions obliquely outwardly and upwardly. The seal between the connected wall (10) and the adjacent floor tiles (11) can be formed by elastically flexible gaskets (25) in the form of strips on both sides of the wall (10) or else the longitudinal edges of the socket profile rails are configured to be elastically flexible and engage on the contiguous floor tiles (11) flexibly and with formation of a seal.

1 Claim, 3 Drawing Sheets

SEALED WALL CONNECTION TO RAISED FLOOR FOR USE IN GERM-FREE CHAMBERS OR THE LIKE

BACKGROUND OF THE INVENTION

The present invention relates to a sealed wall connection to raised floors for use in germ-free chambers or the like, of which the floor tiles are laid out on upright posts.

It is known to arrange rectangular profile pipes laid out on the posts of raised floors, between which are arranged the floor tiles and wherein they are supported with their corners on the posts. The light construction material walls are mounted sealed onto these rectangular profile pipes for the purpose of subdividing the chamber. The wall installation, however, is inconvenient and complicated and requires placement of boreholes in the floor tiles. The floor tiles are then difficult to remove in the area of the wall when such a need arises. Also, the numerous seams remain visible between the rectangular profile pipes laid out in the grating and the floor tiles, and also remain visible in the area of the wall connection, which is quite undesirable for a variety or reasons (among others, because of collecting dirt).

Raised floors are also already known in which profile rails are arranged in the grating on the posts and are covered over, wherein only a small seam remains between adjacent floor tiles. The profile rails in this case, however, serve solely for static reinforcing of the raised floor.

SUMMARY OF THE INVENTION

The object of the present invention is to provide a wall connection with raised floors which is simple to produce and is sealed, for use in germ-free chambers or the like, in which adjacent floor tiles define only a small seam, which is covered in the area of the wall connection and in which, furthermore, the floor tiles in the area of a connected wall can be simply and rapidly disassembled and then also reassembled in case of an emergency.

According to the invention, the aforementioned object can be attained in that:

(a) the wall to be connected is connected at its bottom edge with socket profile rails, of which the width at the widest portion corresponds to the wall thickness;

(b) the socket profile rails are supported on upright support members provided on the posts between the floor tiles;

(c) the socket profile rails extend with their bottoms from the middle in opposite directions obliquely outwardly and upwardly; and (d) elastically flexible gaskets are provided between the two sides of the wall and the adjacent contiguous floor tiles.

According to this construction, the floor tiles can advantageously be supported with their corners on the posts, while the wall is supported over the socket profile rails on upright support members which are provided at least on the posts. The assembly of this wall connection is essentially quite simple and, as a result of the special configuration of the bottom of the socket profile rails, the raised floor tiles even in the area of the wall which is connected can be rapidly and simply disassembled and then reassembled and installed. The elastically flexible gaskets between the two sides of the wall and the contiguous floor tiles are necessarily especially for use in high pressure, germ-free chambers and they can be sufficiently elastically deformed for the removal of the floor tiles in the area of a connected wall without losing their intended function. With this solution to the problem, it is also important that all of the tiles of the raised floor, even including those in the area of the wall connection, have substantially identical quadratic designs and dimensions, and that only a small seam be present between adjacent floor tiles, which seam is covered by the connected wall.

Another solution to the aforementioned problem is characterized in that:

(a) the wall to be connected is connected at its bottom edge with socket profile rails of which the width at the widest portion corresponds to the wall thickness;

(b) the socket profile rails are supported on upright support members provided at least on the posts between the floor tiles; and (c) the socket profile rails engage with their two longitudinal edges sealed onto the contiguous floor tiles, and these longitudinal edges are configured to be elastically flexible. Instead of application of the gaskets on the side of the wall as in the first solution, in the second solution the longitudinal edges of the socket profile rails are advantageously configured as packing elements, which for instance may produce the required packing and seal between the wall and raised floor in the case of germ-free chambers which are under high pressure. This solution is therefore characterized by a structural simplification in which the socket profile rails fulfill two functions simultaneously.

In further configurations of the invention, the upright support members can consist of journals or the like screwed coaxially into the posts, which are connected with the socket profile rails by means of screws, in which the journals extend upwardly through hollow spaces which are formed by truncating the corners of adjacent floor tiles. The hollow spaces with the unused journal-like upright support members could be simply closed off by cover plates.

Another configuration of the invention is characterized in that:

(a) the socket profile rails have a longitudinal fillet in the middle, projecting downwardly;

(b) the floor tiles on both sides of the wall which is to be connected define a gap for convenient incorporation of the longitudinal fillet of the socket profile rail; and (c) the socket profile rails with their longitudinal fillets are connected with upright support members which are formed by profiles laid out in a known manner in the grating on the posts between the floor tiles. With this embodiment of the invention, the profiles which serve as upright support members are laid out in the raised floor and are covered over; in other words, they are closed off at the top by overlapping cover plates on the raised floor tiles. Only the floor tiles present on both sides of the wall which is to be connected have a different form in comparison with the other floor tiles, in order to form the gap for convenient adaptation and incorporation of the longitudinal fillet of the socket profile rails. In other words, with these floor tiles the corresponding overlapping segments of the cover plates are not present. The aforementioned gap between adjacent floor tiles is covered over on top by the socket profile rails or respectively the wall, and only a small seam is present between the adjacent floor tiles which are removed from the connected wall, which is advantageous.

Still another feature of the invention is characterized in that the socket profile rails have a U-shaped longitudinal fillet, wherein from both of the top longitudinal edges of which wall segments extend downward at some distance from the sides, of which the bottom longitudinal edges are bent outwardly and engage flexibly and also with a seal on the contiguous floor tiles, and that the wall to be connected can be inserted with a longitudinal rib or some similar projections conveniently and with proper adaptation into the top open longitudinal fillet of the socket profile rails. These socket profile rails could for instance be manufactured at low cost from a suitable sheet metal material.

BRIEF DESCRIPTION OF THE DRAWINGS

The invention is to be explained in further detail hereinafter relative to the drawings of the exemplary embodiments. In the drawings.

DESCRIPTION OF THE PREFERRED EMBODIMENTS

Figure 1:
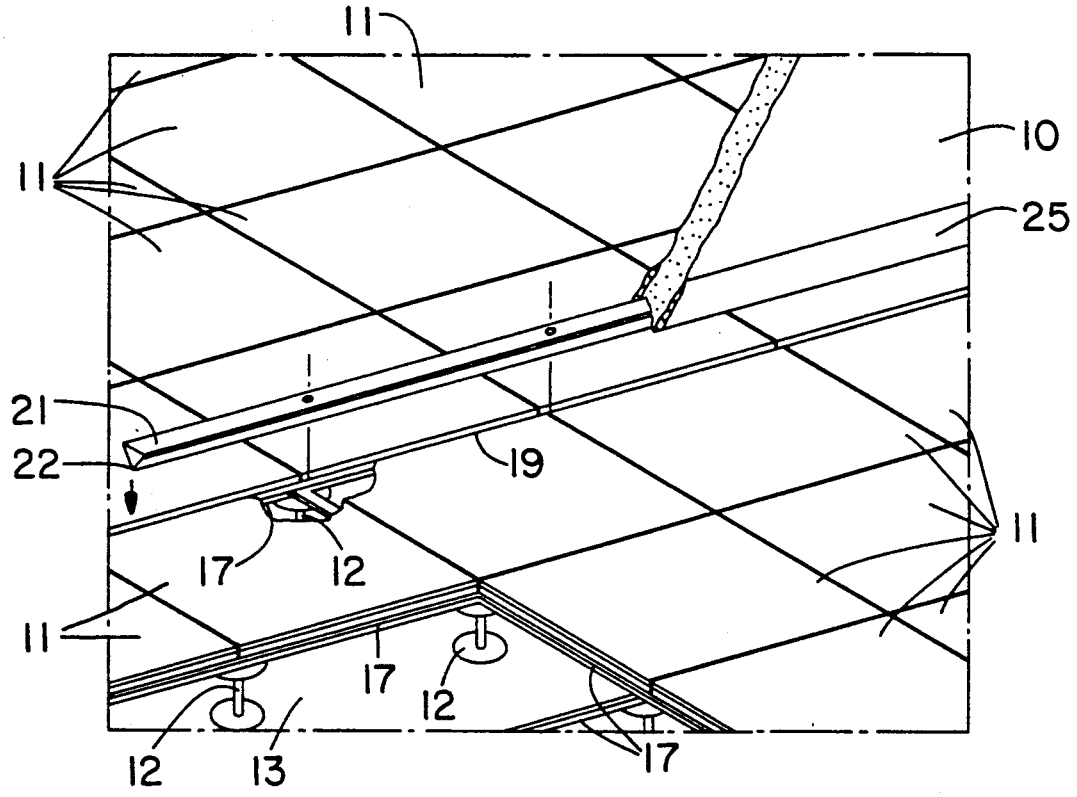
FIG. 1 is a perspective view of a section of a raised floor from above, partially with removed floor tiles and with a gap for partial incorporation of a socket profile rail, which is indicated with a part of its associated wall over the raised floor.
Figure 4:
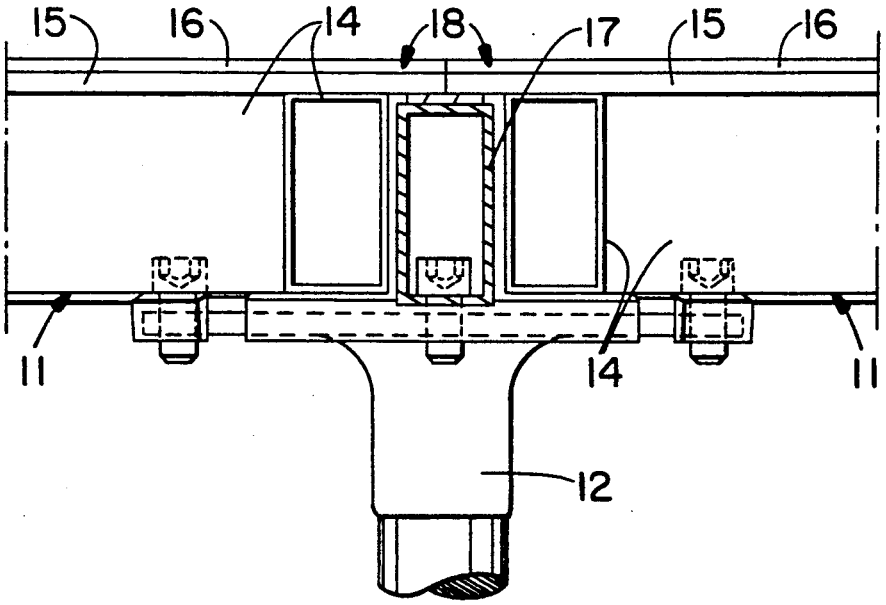
FIG. 4 is a larger scale sectional view of the feature B of FIG. 2.

A part of a raised floor for a germ-free chamber is shown in FIG. 1, wherein it is subdivided by a wall (10) of light construction material. The raised floor consists of a plurality of floor tiles (11) in cantilevered arrangement, which are supported with their corner on posts (12). Posts (12) are resting on the foundation or subsoil (13) beneath the germ-free chamber and can be height adjustable for the levelling of floor tiles (11). The germ-free chamber can be, for example, a production chamber for microscopic structural elements or an experiment chamber or laboratory chamber. Floor tiles (11) in the exemplary embodiments of FIGS. 1 to 6 comprise a bearing grating made up of rectangular pipes (14) which are welded together, on which are fastened in turn a cover sheet (15) and then on this cover sheet a floor tread plate (16). Floor tiles (11), as shown in FIG. 4, could be connected securely with their posts (12) by screws or the like.

In the exemplary embodiments shown in FIGS. 1 to 5, profiles (17) in the form of rectangular pipes are laid out between floor tiles (11) in the grating on posts (12). These profiles (17) are normallY covered over by overlapping segments (18) (FIG. 4) of cover sheets (15) and of floor tread plates (16). In the area of wall (10) which is to be connected, the segments (18) overlapping on all sides of each floor tile (11), however, are at some separation therefrom, in order to form a gap (19) (FIG. 5), of which the purpose is to be explained hereinafter.

Figure 3:
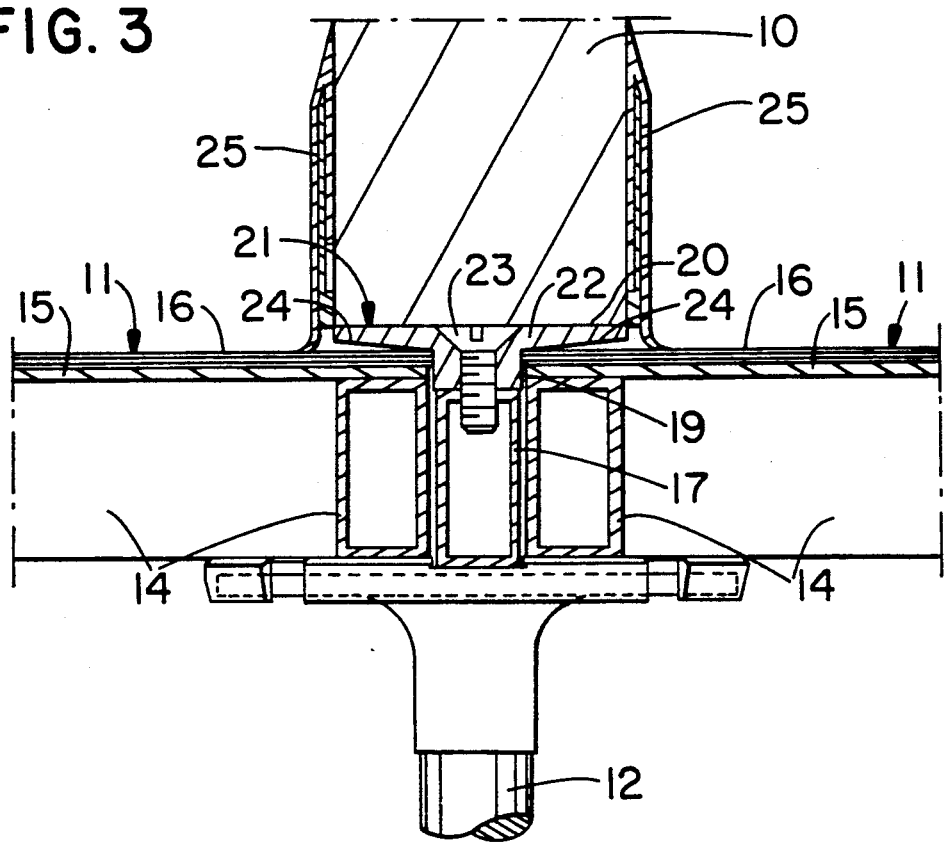
FIG. 3 is a larger scale sectional view of the wall connection at A in FIG. 2.

One or more socket profile rails (21) are fastened to the bottom edge 20 of the wall (10) in any suitable manner such as by an adhesive or the like. The width of these socket profile rails (21) corresponds in the exemplary embodiment of FIG. 3 substantially to the thickness of wall (10). Socket profile rail (21) has a longitudinal fillet (22) in the middle which is tip-stretched into shape, projecting downwardly, which fits exactly into the gap (19) between adjacent floor tiles (11). With wall (10) connected, this longitudinal fillet (22) of socket profile rail (21) is supported on the rectangular pipes or profiles (17) lying in a straight line, of which the width corresponds approximately to the width of longitudinal fillet (22). These profiles (17), therefore, form upright support members for wall (10) which carry its weight to the posts (12). Socket profile rail (21) is connected by screws (23) with profiles (17) arranged in a straight line. One or more socket profile rails (21) may be provided, accordingly to the length of the wall (10) which is to be connected, and the bottom (24) of the socket profile rail extends from the middle longitudinal fillet (22) away in opposite directions obliquely outwardly and upwardly, as shown in FIG. 3. As a result of these measures, with connected wall (10), in case of an emergency, the contiguous floor tiles (11) can be simply and rapidly removed and also reassembled. Additional elastically deformable gaskets (25) of strip configuration are fastened to both sides of wall (10), for instance glued on, which engage flexibly on contiguous floor tiles (11) and produce a packing between wall (10) and the raised floor, which is required for a germ-free chamber in which a slight pressure is generally present.

Figure 5:
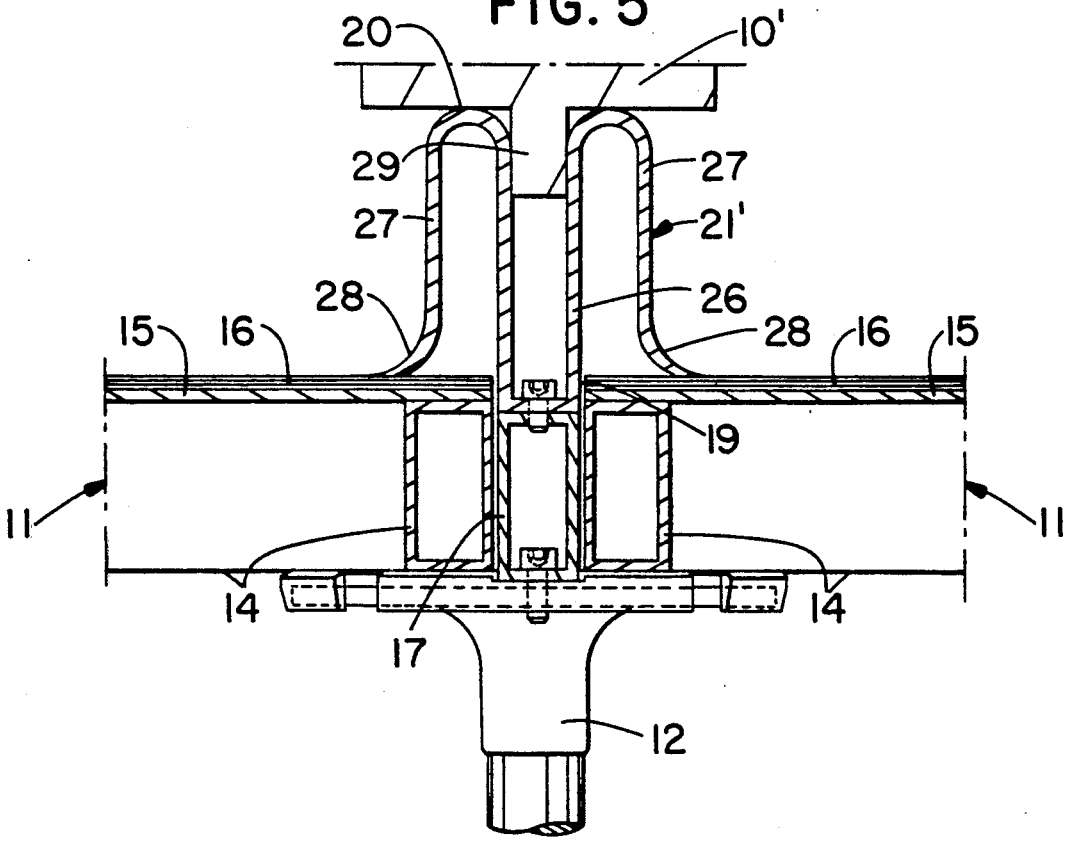
FIG. 5 is a sectional view of a wall connection with a modified socket profile rail.
Figure 2:
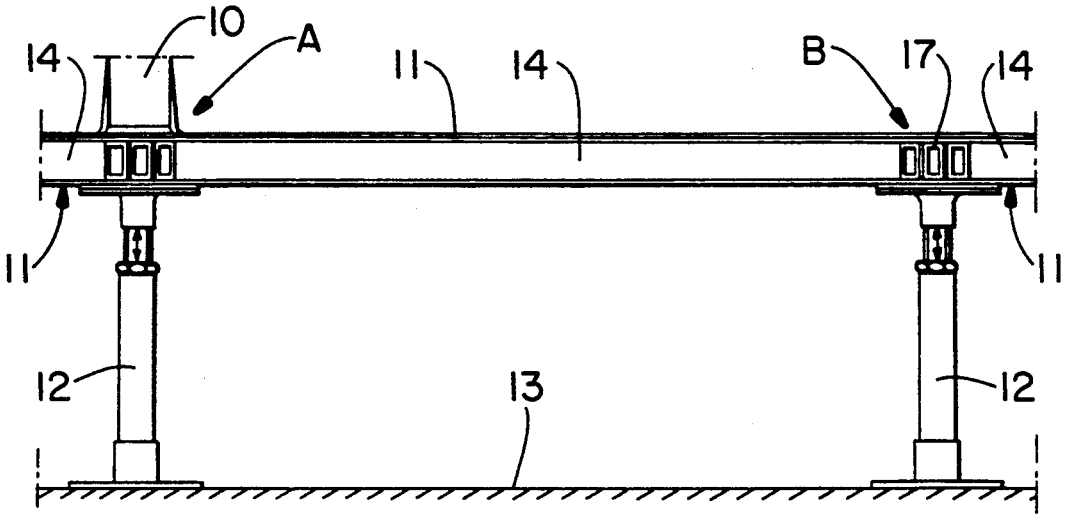
FIG. 2 is an enlarged sectional view of a part of the raised floor which is shown in FIG. 2 with a wall shown connected to the raised floor.

In the exemplary embodiment shown in FIG. 5, wall (10') is connected over one or more modified socket profile rails (21'). One particular feature is that identical ratios and dimensions as in FIG. 3 are present and identical parts are therefore identified with the same references. Socket profile rail (21') can for instance be manufactured of zinc-coated sheet metal and it has a U-shaped longitudinal fillet (26), which is supported with connected wall (10') on profiles (17) which are lying in a straight line and is screwed together with these profiles. Wall segments (27) are bent outwardly and downwardly from the top longitudinal edges of U-shaped longitudinal fillet (26), and the bottom outward bent longitudinal edges (28) engage flexibly and with a seal on covering plate (16) of the adjacent floor tile (11), and under the influence of the weight of wall (10'), which engages with a longitudinal rib (29) on its bottom (20) fitting into longitudinal fillet (26) of socket profile rail (21') which is open at the top.

Figure 6:
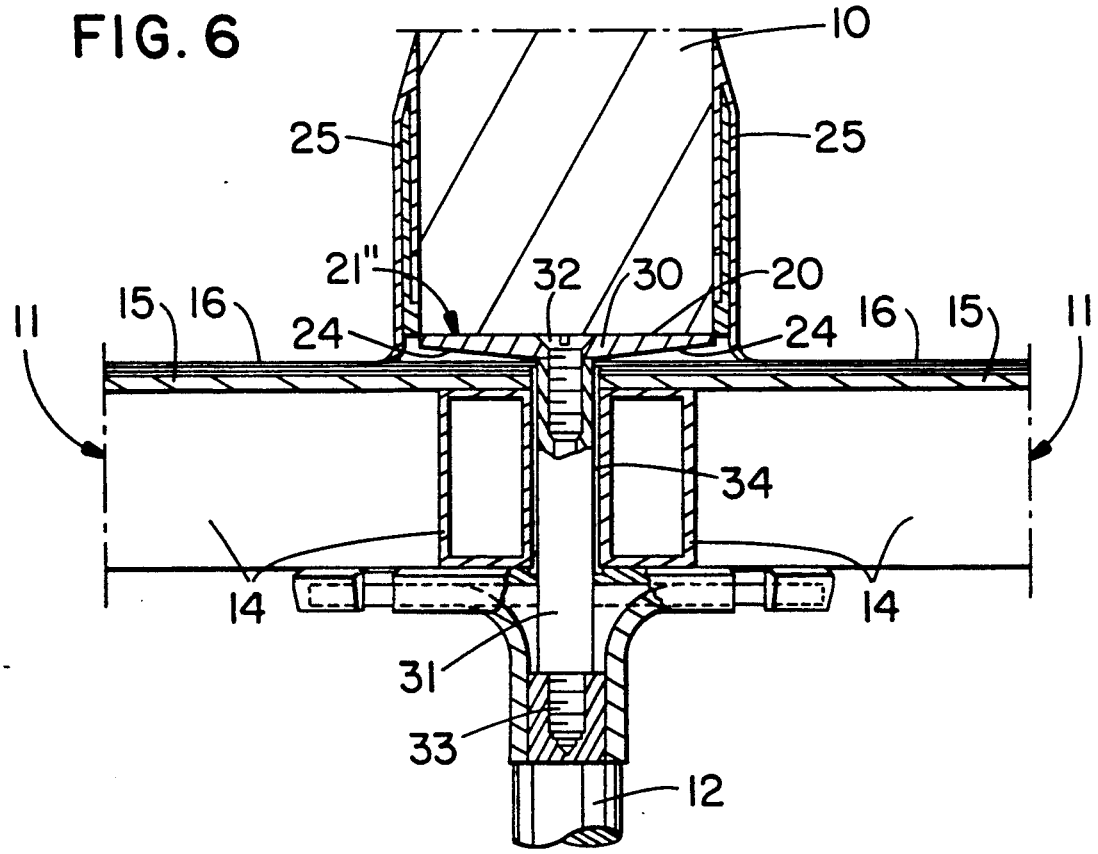
FIG. 6 is a sectional view similar to that of FIG. 3, but of a wall connection in which the socket profile rails are supported only on journal-like upright support members on the posts.

In the exemplary embodiment shown in FIG. 6, socket profile rail (21'') has no longitudinal fillet in the middle, but rather its bottom is made up of a flat longitudinal segment (30) which is in the middle and in strip shape, as well as segments (24) which run outwardly and upwardly obliquely in opposite directions, similar to the exemplary embodiment shown in FIG. 3. Socket profile rail (21'') is in this case supported only on journal (31) and is connected therewith by a screw (32). The journals (31) are screwed by means of a threaded segment (33) into a corresponding threaded bore in post (12), and these posts (12) lie in the straight line of the wall (10) which is to be connected. However, it is also possible to provide all of the posts (12) of the raised floor with such journals (31) that they may execute wall connections at any desired points of the raised floor, and then the journals (31) which are not required for support can be covered by caps (not shown). Journals (31) extend upwardly through hollow spaces (34), and the hollow spaces are formed by truncating the corners of any four floor tiles (11) which are coming together at a post (12). These hollow spaces (34) between floor tiles (11) can therefore be of quadratic design and, as explained above, journals (31) can be covered over by caps when not in use.

What is claimed is:

1. Sealed wall connection with a raised floor for use in germ-free chambers or the like, wherein the floor comprises floor tiles that are laid out on upright posts, characterized in that:

(a) the wall (10) has a bottom edge (20), socket profile rails (21) are connected to said bottom edge (20) and have a greatest width that corresponds substantially to the thickness of said wall (10);

(b) upright support members are provided on the upright posts (12), and the socket profile rails (21) are supported on said upright support members between the floor tiles (11);

(c) the socket profile rails (21) have a middle portion and bottom surfaces (24) that extend from said middle portion outwardly in opposite directions obliquely outwardly and upwardly;

(d) the wall (10) has two sides, and an elastically flexible gasket (25) extends between each side of the wall and the adjacent portions of the floor tiles (11);

(e) the socket profile rails (21) have a longitudinal fillet (22) extending downwardly from said bottom surface at said middle portion thereof;

(f) the floor tiles (11) along the sides of the wall (10) define a gap (19), and said longitudinal fillet (22) extends downwardly through said gap (19); and (g) the longitudinal fillet (22) of the socket profile rails (21) is connected with said upright support members on said posts (12) between the floor tiles (11).

* * * * *